US005660087A

United States Patent [19]

Rae

[11] Patent Number: 5,660,087

[45] Date of Patent: Aug. 26, 1997

[54] DRILL PIPE SPINNER

[76] Inventor: Donald David Rae, 1 Regency Ct., Conroe, Tex. 77304

[21] Appl. No.: 512,490

[22] Filed: Aug. 8, 1995

[51] Int. Cl.[6] ..... B25B 17/00

[52] U.S. Cl. ..... 81/57.2; 81/57.16; 81/57.19; 81/57.25

[58] Field of Search ..... 81/57.15, 57.16, 81/57.19, 57.2, 57.24, 57.25, 57.33, 57.34, 57.35, 57.4, 57.41, 57.42, 57.43, 57.46

[56] References Cited

U.S. PATENT DOCUMENTS

| | | | |
|---|---|---|---|
| 2,536,458 | 1/1951 | Munsinger | 81/57.19 |
| 2,544,639 | 3/1951 | Calhoun | 81/57.19 |
| 3,906,820 | 9/1975 | Hauk | 81/57.34 |
| 4,309,922 | 1/1982 | Beckley et al. | 81/57.19 X |
| 4,446,761 | 5/1984 | Boyadjieff et al. | 81/57.19 |
| 4,694,712 | 9/1987 | Doss | 81/57.2 |
| 5,092,150 | 3/1992 | Cunningham | 72/369 |

*Primary Examiner*—D. S. Meislin

[57] ABSTRACT

A drill pipe spinner is set forth. It is suspended under a hanger and has upper and lower mounting plates. An air motor with cooperative gear box is supported on the upper mounting plate and extends a rotatable shaft through the mounting plate to rotate a driven sprocket. Through the use of suitable sprockets, symmetrically located left and right rollers arc rotated. In addition, the device incorporates an air cylinder which has an extending piston rod which connects by means of a bell crank which clamps the drill pipe.

13 Claims, 5 Drawing Sheets

DRILL PIPE SPINNER

BACKGROUND OF THE DISCLOSURE

This disclosure is related to application Ser. No. 08/236,390. The present disclosure is directed to a drill pipe spinner and more particularly to a drill pipe spinner which is adapted for use in handling drill pipe of several specified size. The device includes an upwardly directed hanger assembly supporting a pair of spaced plates which encompass an assembly enabling a drill pipe to be grasped by left and right drive rollers which are held snugly against the drill pipe by left and right pressure rollers. The pressure rollers are mounted on bell crank mechanisms which swing out of the way to open the equipment so that the drill pipe can be inserted, and which swing inwardly to position the pressure rollers against the drill pipe so that the drill pipe is forced against the drive rollers. This forms a clamping mechanism which is able to clamp the drill pipe with four regions of contact. Two regions of contact include the drive rollers, duplicated symmetrically on the left and right, and the remaining two areas of contact are the pressure rollers. As a generalization the drill pipe is snugly held so that it is driven in a specified direction for threading or unthreading of the drill pipe. This accommodates pipe of a large range of diameters using an improved bell crank mechanism.

In drilling for oil and gas, it is necessary to assemble a suing of drill pipe joints. The string of drill pipe is suspended by the overhead derrick. As the well is drilled deeper, it is necessary to periodically add another joint of drill pipe. Drill pipe normally comes in standard lengths, a typical length being 30 feet. Drill pipe normally is threaded into the drill string so that the drill string can be deepen to extend the well. In doing this, the drill pipe added to the string is incorporated at the wellhead by connection between the drill string that is already in the well borehole and is threaded below the Kelley. The Kelley is the driving element which cooperates with a powered rotary table. The Kelley is formed of a non-round shape and extends through a matching hole in the rotary table. This permits the Kelley to travel upwardly and downwardly so that the Kelley is able to drive the drill string from rotation imparted by the rotary table.

The present apparatus is a system which incorporates an air motor connected with a suitable gear box. The air motor in turn is provided with a flow of air which operates the air motor and which therefore rotates a sprocket at the end of the gear box and air motor. The sprocket drives a belt or chain. The chain extends to drive sprockets which are mounted in on shafts for rotating the two drive rollers.

One important aspect of the present apparatus is the incorporation of an air cylinder which is pivotally mounted at one end and which has a piston rod extending from the other end. The piston rod is constructed so that it connects with a sleeve which in turn is joined to a bell crank mechanism pivotally mounted with the sleeve.

The bell crank mechanism is rotated so that the bell crank rotates toward and away from the drill pipe to provide clamping motion. The bell crank is able to hold a range of drill pipe sizes.

Going now to one aspect of the present disclosure, it is particularly useful in providing a wide grip on the drill pipe. After drill pipe has been used for a while the scuffed external surface is highly irregular. The present system sets forth a means and mechanism by which the drill pipe is grasped on a relatively wide roller. The roller is wide so that the grip on the roller can be readily spread over an area to assure that the external surface of the drill pipe is frictionally engaged, thereby preventing slippage, and enabling the drill pipe to be rotated.

In general terms, the present apparatus is therefore summarized as an inverted U-shaped hanger which extends upwardly above a pair of mounting plates. The hanger connects to the upper mounting plate. The upper mounting plate has an area which supports a housing which encloses an air motor connected with an integrally constructed gear box for rotating a shaft which drives a sprocket. The sprocket engages a flexible chain or belt which is looped operatively through an pressure sprocket and drive sprocket. Actually, two drive sprockets are included. The two drive sprockets are located in spaced relationship to each other to position two drive rollers which bear against a drill pipe. In addition to the foregoing, the equipment includes a pair of pressure rollers which are similar to the drive rollers. The two pressure rollers are independently mounted. They are mounted so that they swing outwardly, opening the throat of the tool for insertion of a drill pipe. They swing inwardly to close thereby enabling the drill pipe to be grasped. They are incorporated in the system so that the drill pipe can be grasped or clamped by the two pressure rollers. This movement is accomplished through the use of a horizontally directed air cylinder which is supported below the top mounting plate and above a bottom mounting plate. At one end it is pivotally mounted by means of a pivot connection to the cylinder housing. The opposite end incorporates an extendible piston rod which is directed outwardly to a clevis mounted on a shaft. The piston rod connects with the clevis to rotate a sleeve and thereby rotate upper and lower parallel bell crank arms. The two arms are parallel to support a pressure roller at the end of the two parallel arms. They are pivotally mounted to thereby permit movement of the bell crank. The bell crank is constructed with a fixed pivot point so that the outer end of the bell crank rotates in an arc to bring the pressure roller on it against the pipe to create a clamping force. Duplicate pressure rollers are included.

The bell crank is constructed with multiple pin insert locations. The enables the clevis on the end of the piston rod to be moved. When moved, this changes the angle of rotation of the piston rod. This changes the pivot connection between the piston rod and bell crank. This changes the leverage and thereby enables the bell crank and pressure roller to grasp at a desirable angle and thereby enable a large diameter pipe to be grasped when positioned at one insert location and a smaller pipe to be grasped when connected at another point.

The duplicate pressure rollers are enabled to grasp many sizes of pipe. The drill pipe can cover a wide range using the features of the present disclosure. By making this provision in the bell crank construction, drill pipe as small as three and one half inch is grasped. It also can accommodate drill pipe as large as seven inches. The pipe spinner apparatus can be used with tubing. Tubing has nominal dimensions of two and three eighths inches or two and seven eighths inches. Accordingly, this system can be used with both tubing and drill pipe and can thereby accommodate a very large range of pipe sizes.

DETAILED DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

DETAILED DESCRIPTION OF THE PREFERRED EMBODIMENT

Figure 1:
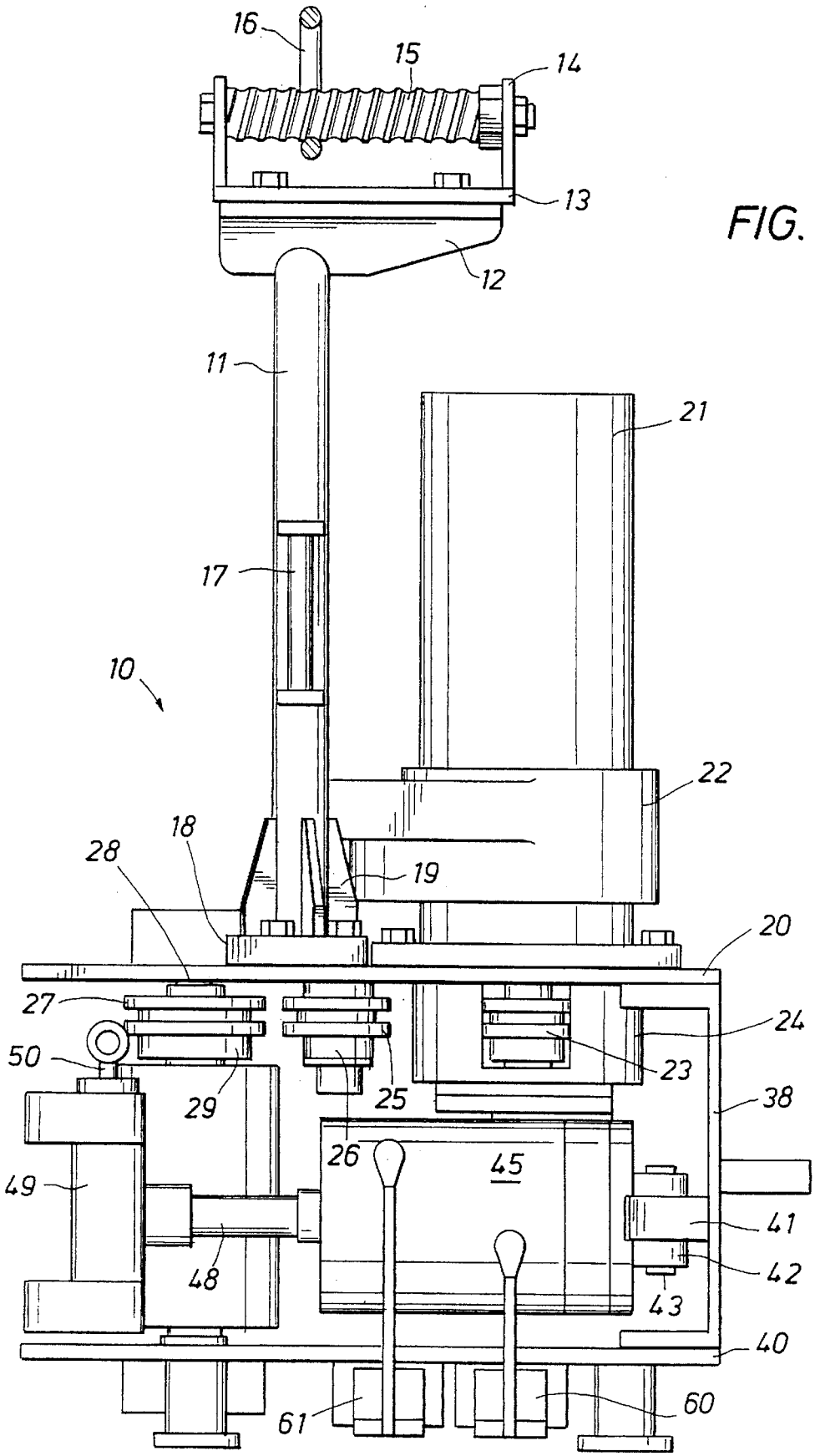
FIG. 1 is a side view of the apparatus of the present disclosure showing details of the upper mounting plate and the parallel lower mounting plate with the drive system supported by the mounting plates for grasping a drill pipe to be rotated.

Attention is now directed to FIG. 1 of the drawings where the numeral 10 identifies the present invention which is generally described as a drill pipe spinner. The description will proceed in FIG. 1 of the drawings from top to bottom. The top portions of the device include an upstanding U-shaped hanger or bale 11 which extends upwardly to and which is supported by a welded bracket 12 connected with the bale. The bracket 12 supports a frame member 13 having a pair of upstanding mounting tabs 14. They in turn support a helically grooved shaft 15 which in turn captures a hanger loop 16 engaged with the helical thread. The hanger loop 16 can be moved to the left or right. Generally, the helical groove is sufficiently deep that the hanger loop does not slip out of a particular groove and thereby slide to one or the other. This assures that the present device stays in a fixed location. This assures that the hanger loop 16 is located at the desired location so that the equipment does not become unbalanced with respect to the overhead support. By way of background, the drill pipe spinner 10 is normally suspended in the derrick in an overhead position so that it can manipulated by the workman at the rig floor. The tool pusher often will control use of this equipment. Because it is relatively heavy, it has to be hung in an overhead position so that the tool pusher or the roustabout can move the device against the drill pipe which is held vertically at the rig floor extending into the well borehole. In summation, the overhead hanger mechanism is believed to be well known and is referred to so that the connection of the hanger loop 16 will be understood.

The hanger 11 incorporates a handle 17 which can be readily grasped by the roustabout to move the device. The hanger extends downwardly with a pair of parallel legs better shown in FIG. 3 of the drawings. The legs extends downwardly to a hanger plate 18 affixed at the bottom of the hanger 11. For safety and solid connection, several gusset plates 19 are also incorporated. As best shown in FIG. 1 of the drawings, there is an upper mounting plate 20 which is connected at right angles to the hanger 11. They are joined by suitable bolts to assure that the hanger 11 is adequately connected with the upper mounting plate. The mounting plate 20 is a mounting or frame member for a number of components. One of the components incorporated in this structure is the housing for a motor. While it is possible to use electric motors, it is preferable for safety and control to utilize an air motor which is provided in the air motor housing 21. The air motor connects with an integrally constructed housing 22 which encloses a gear box. The air motor drives the gear box and the gear box in turn drives an output shaft which is keyed to a motor sprocket 23. The motor sprocket 23 is rotated when the motor is turned on. It drives a flexible belt or link chain, depicted by broken lines and identified by number 31, to engage an idler sprocket 25 and a drive sprocket 27 shown in FIG. 1 of the drawings. As will be understood the link chain or flexible belt drive is tensioned properly engage the various sprockets as will be detailed.

Figure 2:
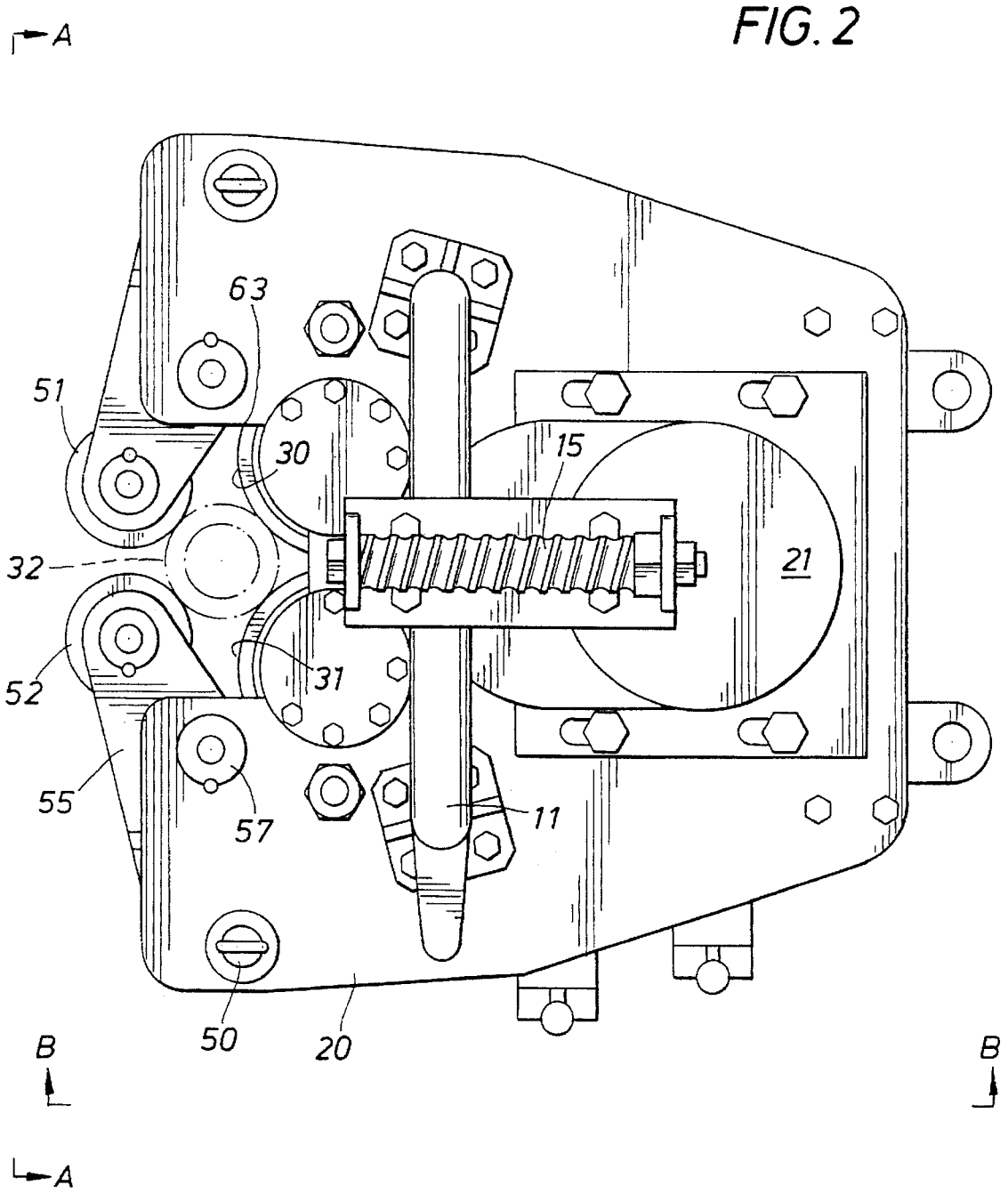
FIG. 2 is a top or plan view of the present invention which is orthogonal to the view of FIG. 1 and is obtained along the line B—B as shown in FIG. 2 of the drawings.

The mounting plate 20 supports a downwardly extending cylindrical housing 24 which serves as a safety shield around a portion of the flexible drive or belt. The shield 24 is fastened or welded to the nether side of the mounting plate 20. In addition to that, the mounting plate 20 also supports a suitable shaft 28' which in turns supports a sleeve 26. The sleeve 26 supports the idler sprocket 25. The idler sprocket 25 is located with respect to the motor sprocket 23 to assure proper tension and engagement with the motor sprocket and a pair of duplicate drive sprockets 27. Each drive sprocket 27, only being shown in FIG. 1, sprocket 27 is mounted on a shaft 28 by means of a sleeve 29, the sleeve 29 supporting the sprocket 27 so that it can be driven by the flexible drive belt 31 which engages the motor sprocket 23, the idler sprocket 25, and each drive sprocket 27. In addition, the shaft 28 extends downwardly through the drive sprocket 27 and also through a drive roller 30 best shown in FIG. 2 of the drawings. The roller 30 is matched by a second roller 31 with an identical shaft and sleeve assembly as that described for the roller 30. The rollers 30 and 31, as are their shafts, cooperating drive sockets and supporting sleeves, are identical and differ only in location. They are both provided so that they have areas of contact against a drill pipe 32 which is shown in FIG. 2 of the drawings. This representative drill pipe is rotated by the two rollers. The rollers rotate at the same speed and in the same direction. They engage the drill pipe to rotate the clamped drill pipe as will be detailed. More specifically, FIG. 2 of the drawings shows that the rollers have a relatively large diameter in comparison with the diameter of the sprocket 27. The rollers are obscured in FIG. 1 of the drawings; it will be appreciated that there are two symmetrically locate driver roller sprockets and they are supported on common shafts thereby enabling the rollers to be in contact with the pipe without interference from the drive sprockets. In other words, the rollers 30 and 31 shown in FIG. 2 of the drawings are larger in diameter than the two drive sprockets. Moreover, for sake of clarity, the two drive sprockets and the connected flexible drive have been omitted from FIG. 2 of the drawings. This enables FIG. 2 to present the two drive rollers which are below the drive sprockets as shown in FIG. 1 of the drawings. As will be understood and in accordance with this drawing convention, the motor 21 is operated, rotation of the motor is transferred to the gear box 22, and the motor sprocket 23 is rotated.

The motor drives the flexible belt or chain to enable the two drive sprockets to be rotated which in turn rotates the two rollers 30 and 31 shown in FIG. 2 of the drawings. This powers the pipe which is clamped against the rollers in a fashion to be described. Returning now to FIG. 1 of the drawings, attention is momentarily directed to a vertically extending back frame 38 which has an upper connective flange enabling the frame 38 to be joined to the top mounting plate 20. The mounting plate 20 has a specified profile shown in the drawings. The same profile is used for the parallel bottom mounting plate 40. The plates are made with a similar outline and are arranged in spaced relationship to each other with the frame 38 between the two plates. This defines an area within the two plates which permits the equipment to be installed and mounted between the two plates. The plates 20 and 40 are mounting plates for a clamp mechanism as will be detailed. The back frame 38 supports a mounting tab 41 which is pinned or fastened to a clevis 42. The pin 43 extends through the tab 41 and the clevis 42. The clevis is located at one head end of an air cylinder assembly 45. The pivot connection obtained by the pin 43 anchors the air cylinder assembly 45 to prevent movement other than pivotal movement about the axis of the pin 43. Moreover, this pivotal connection assures that the air cylinder motion is directed to the clamping mechanism. The air cylinder is provided with an internal piston (not shown) which connects with a protruding piston rod 48. The rod 48 extends to a sleeve 49 which is about a shaft 50. The shaft 50 is a pivotal connection between the air cylinder 45 by means of the piston rod 48, on the one hand, and connects with a bell crank mechanism to be described. Description of the bell crank mechanism is best understood by momentarily going to FIG. 3 of the drawings. Before going into the details of that, FIG. 3 is best understood by generally noting the function which is accomplished in the device.

Figure 3:
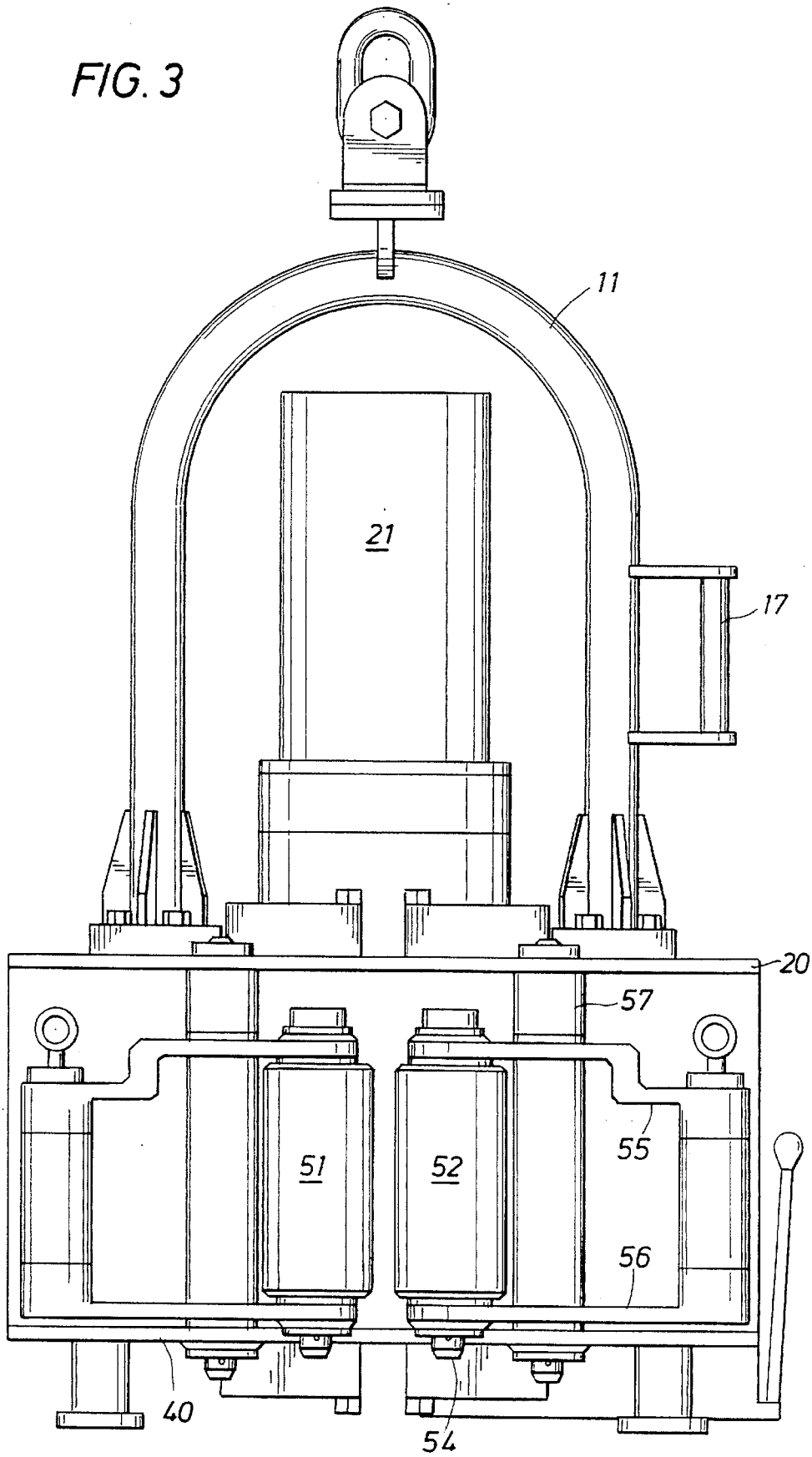
FIG. 3 is an orthogonal view taken along the line A—A as shown in FIG. 2 which shows additional details of construction.

Viewing FIGS. 1 and 3 jointly, the mounting plates 20 and 40 again are shown in FIG. 3. The view of FIG. 3 is at right angles to FIG. 1; in particular, this view shows duplicate left and right pressure roller assemblies which clamp against the drill pipe. More specifically, left and right pressure rollers 51 and 52 are incorporated. They operate in symmetrical and similar fashion. They are symmetrical with respect to the centerline axis of the drill pipe. This enables the two rollers to function in a clamping mechanism. The rollers 51 and 52 are not driven; rather, they are free to rotate with the drill pipe which in turn is rotated by the drive rollers 30 and 31 previously mentioned. More specifically in FIG. 3 of the drawing, the roller 52 is supported on an upstanding shaft 54. That shaft is captured between an upper bell crank arm 55 and a similar bell crank arm 56 which is the bottom bell crank arm. It will be noted that the arm 55 has an offset portion. This offset is incorporated simply to shorten the length of the sleeve 49 previously mentioned. Continuing however with FIG. 3 of the drawings, the upper bell crank 55 is mounted for rotation with respect to an arm pivot shaft 57. The shaft 57 serves the define an arm pivot point. The shaft 57 is also shown in FIG. 2 of the drawings. There, the arm 55 is shown to extend out from the area directly between the mounting plates 20 and 40. The mounting plate 20 in FIG. 2 has been broken away to show the cylinder clevis shaft 50. The bell crank mechanism 55 is pivotally mounted so that it rotates about the shaft 57. Generally speaking and referring to FIG. 2 of the drawings, the bell crank arm 55 is moved to only two positions. In the clamping position, the bell crank is moved by the air cylinder 45 to the full line illustrated position in FIG. 2 of the drawings. This is the clamping position, and is the position which is used to clamp the drill pipe, rotate the drill pipe and assure that the drill pipe is properly grasped and rotated. As further shown in FIG. 2 of the drawings, the drill pipe is engaged in four rollers. Contact of the two drive rollers is noted, but that contact is enhanced and indeed assures success by the incorporation of the two pressure rollers. The pressure rollers 51 and 52 are not powered which means that they are free to rotate with the drill pipe. They are used in a clamping motion to assure that the drill pipe is held snuggly against the drive rollers. Moreover and continuing with FIG. 2 of the drawings, the bell crank arm 55 is able to be rotated toward the drill pipe or away from the drill pipe. When the air cylinder 45 is operated, the roller 52 is pulled away from the drill pipe when that occurs, and disengagement is accomplished.

Going back now to FIG. 3 of the drawings, the bell crank arms 55 and 56 are parallel to each other so that the roller 52 is mounted so that it will sustain the vertical or upstanding position. The roller 52 is pivotally moved around the arm pivot point defined by the arm pivot shaft 57 for contact with the drill pipe 32 in the illustrated fashion. While little mention has been made of the roller 51, it is operated in the same fashion by symmetrically constructed equipment. Thus, where one roller is pulled into contact with the drill pipe, the second pressure roller is also moved into operative contact so that the drill pipe is engaged by all four of the rollers.

Continuing with the details of the pressure roller mechanism, FIG. 1 of the drawings shows a pair of control valves. A throttle control valve 60 is included. It controls the flow of air through an air supply line (not shown) which is delivered to the air motor 21 and which causes the air motor to rotate. In addition to that, a second control valve 61 is included. The valve 61 controls the application of air to the air operated cylinder 45. That cylinder is provided with its power from the same air line. Typically, this requires the use of regulated air which is perhaps regulated at 100–200 psi. If desired, an air pressure regulator can be incorporated. Both the valves 60 and 61 are provided with hand grip control levers shown in FIG. 1 of the drawings so they can be operated.

Going now to FIG. 2 of the drawings, one aspect of the present disclosure is the throat 63 which is formed in the mounting plate. It is sufficiently deep that it exposes the rollers 30 and 31. It is sufficiently wide and deep to assure that a specific size range can be engaged by the system. The throat 63 defines a gap in which the drill pipe can be positioned. As shown in this particular representative situation, the drill pipe is relatively easily fitted within the throat 63.

In operation, the device of the present disclosure is suspended in a derrick above the rig floor at a drilling rig location. When it is needed, it is swung over by the roustabout. It is typically opened at the throat 63 as a preliminary step. This can be done by control of the valve 61 which applies air pressure to the double acting cylinder 45, causing the piston rod 48 to be retracted. When that occurs the bell crank 55 shown in FIG. 2 is moved. Such movement is around the arm pivot defined by the arm pivot shaft 57 which thereby removes the pressure rollers 51 and 52 from contact with the drill pipe. In other words, the throat is opened wide so that the drill pipe can be moved into engagement. As desired, the two pressure rollers 51 and 52 can then be moved into a clamping relationship. This is under control of the valve 61. Once the pipe has been clamped as illustrated in FIG. 2 of the drawings, air is provided to the air motor 21 under control of the valve 60. This enables subsequent operation of the system.

The device can be used to rotate first one pipe and then another, etc. On each operation, the pressure rollers 51 and 52 are moved away from contact with the pipe. In other words, clamping action is terminated by opening the throat 63 to permit engagement with another pipe. When that occurs, the pipe is moved into contact with the rollers 30 and 31 and then the valve 61 is operated to close the two pressure rollers. Loosely speaking, the door is closed to capture by clamping the drill pipe 32.

Thereafter, the device can be operated simply by applying air under pressure under control of the valve 60. This operates the motor 21 and thereby enables the powered rollers 30 and 31 to be rotated. This assist in spinning the drill pipe in making up the drill string.

The drive rollers are preferably formed of a hard plastic material so that they are sacrificial sleeves which fit about supportive metal sleeves. The "sacrificial" sleeves contact the drill pipe, receive the wear resulting from this contact, and can be easily and inexpensively replaced thereby avoiding wear on the more expensive support metal sleeves. For instance, can be up to about one-half inch in thickness. They are preferably formed of polyurethane with a machined external surface which is relatively smooth. The hardness can vary over a wide range but typically the hardness is in the range of about 50–80 durometer which is a hardness sufficient to last for many cycles of operation. When worn, these sleeves become slightly rough or abraded on the outer surface.

ACCOMMODATION OF SEVERAL PIPE SIZES

Figure 4:
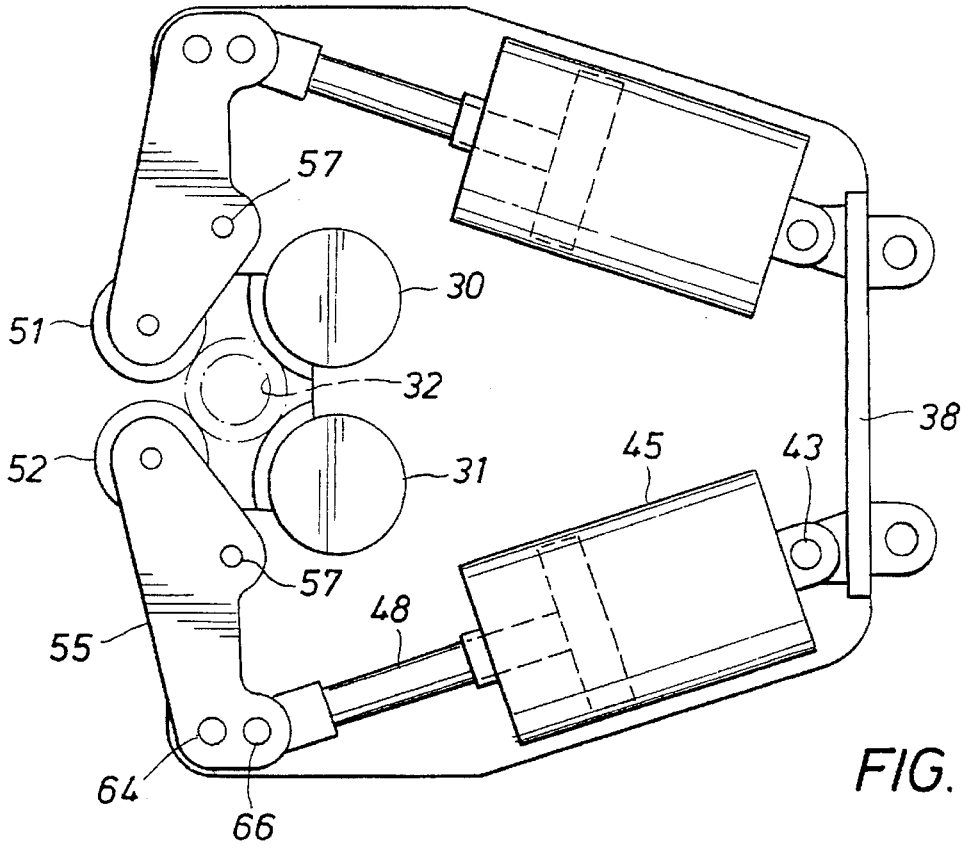
FIGS. 4–7 inclusive show different sizes of pipe in the grasp of the improved drill pipe spinner of the present disclosure.
Figure 5:
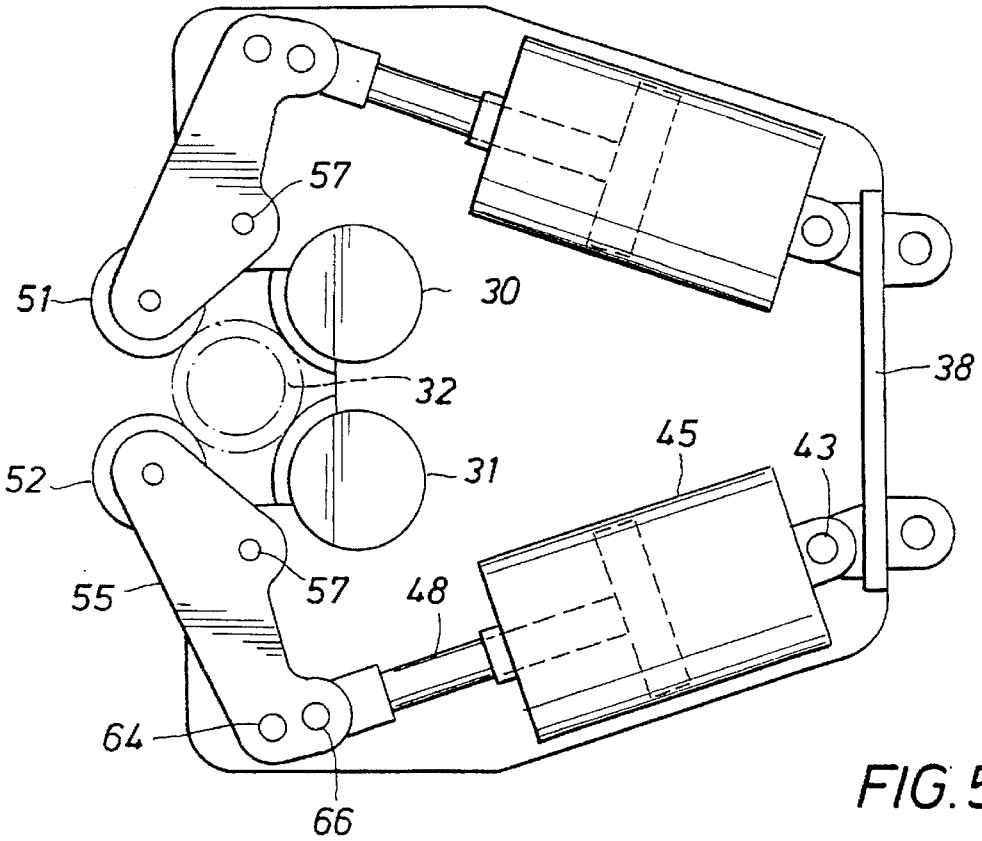
Figure 6:
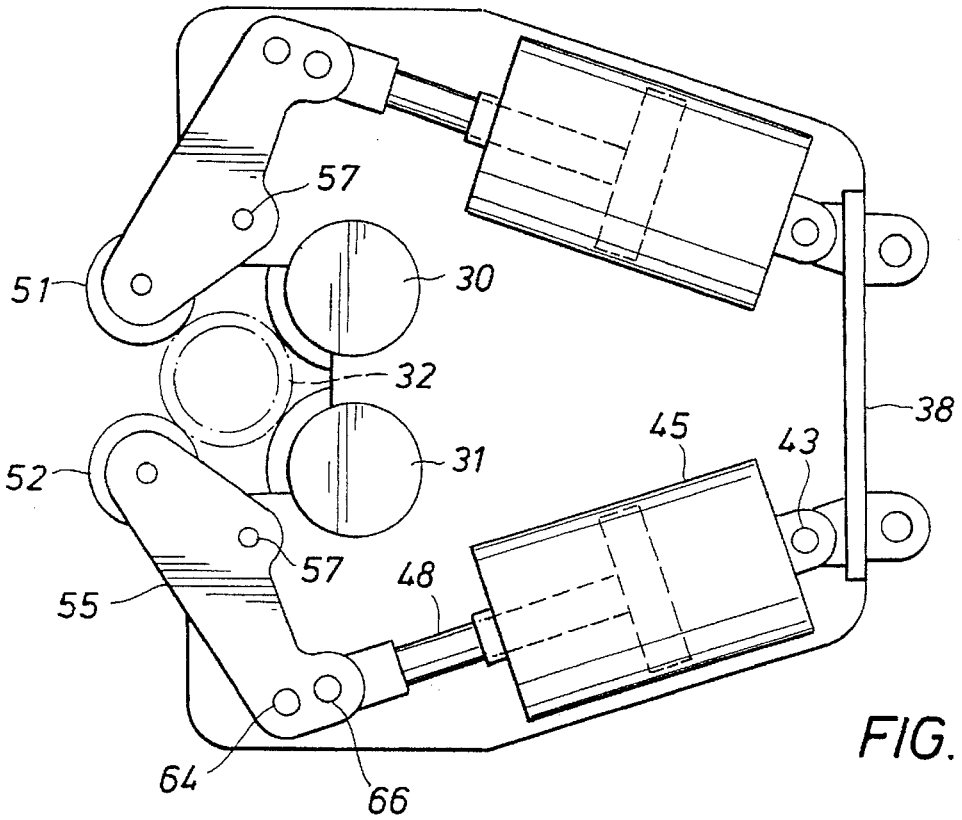

Consider the situation which occurs in drilling a deep well. Because of the weight of the drill stem, it may be necessary to reduce the drill pipe size at the lower portions of the drill stem. The drill stem is tapered by using an increasing diameter in pipe proceeding up the drill stem. For instance, the lower most drill pipe might have a nominal size of four inches and the topmost pipe might have a size of five inches. With a longer drill suing, it is necessary to use a greater range of pipe. The present apparatus is able to accommodate several pipe sizes and still provide clamping at a desired angle. Attention is momentarily directed to FIG. 4 of the drawings which is a simplified representation of the clamping action which is accomplished in the present invention. There, the pipe 32 has been clamped by both the drive rollers and the two pressure rollers. As illustrated, the angle of contact defined in the throat is thirty eight and one half degrees in clamping three and one half inch pipe. While FIG. 4 shows clamping that size pipe, FIG. 5 shows four and one half inch pipe clamped with an angle of forty five and one half degrees. FIG. 6 shows a five inch pipe clamped with a clamp angle of forty nine degrees. In moving up to five and one half inch pipe, the bell crank mechanism is modified so that a clamping angle of fifty three degrees is obtained. With a given size of equipment and a specified stroke in the air cylinder, rotation of the bell crank mechanism is limited.

Figure 7:
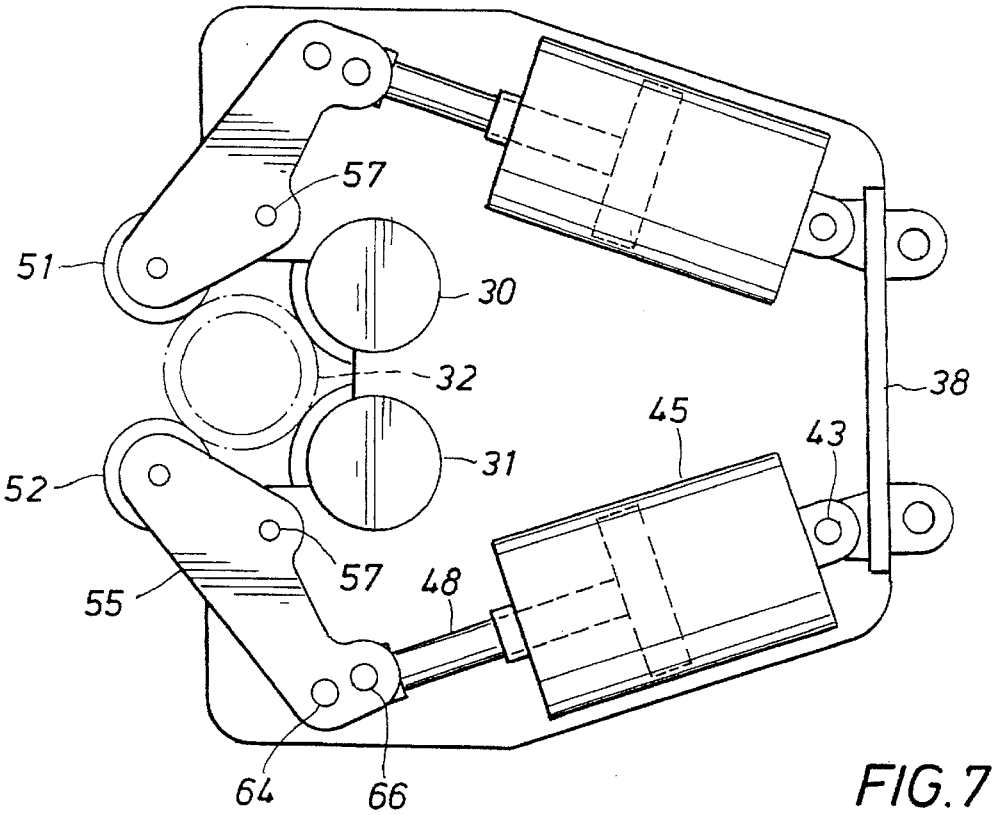

The present invention shows a simple mechanism by which the invention can clamp the pipe 32 at a desired angle and which is adjustable as needed. The pipe 32 must fit through the pressure rollers 51 and 52. They are required to swing open by a specified distance. As the pipe gets larger, the gap or opening width of the rollers 51 and 52 must be greater. This is a self defeating requirement because a larger opening is needed to admit a larger diameter pipe. The arm pivot point defined by the arm pivot shaft 57 for the bell crank 55 is fixed. The rotation of the bell crank to the open position to admit a larger pipe can be enhanced by changing the connection point on the bell crank 55. In the present disclosure, the bell crank is therefore provided with two additional openings defining clevis pivot points 64 and 66, each of which can be used to connect the piston rod 48 to the bell crank 55 by means of the clevis pin 43. This defines one form of bell crank, adjuster which can adjust the pipe spinner 10 to receive a wide range of pipe diameters as will be illustrated. For the smaller diameter pipe as shown in FIG. 4, the clevis pivot point 66 is used. For a larger diameter pipe shown in FIG. 7, the clevis pivot point 64 is used. This changes the rotational motion of the bell crank 55. For a fixed stroke length on extension or retraction of the piston rod 48, the rotation is made greater or is reduced depending on the requirement. When the rotational angle is increased and the throat is more widely opened, pipe can be thrust between the pressure rollers 51 and 52. When they are closed, they make contact at the illustrated contact angles in FIGS. 4, 5, 6 and 7 so pipe is adequately clamped. Indeed, this range of clamping is sufficient to enable clamping and holding the pipe for a wide range of drill pipe.

If desired, the pipe spinner 10 can be used with a production tubing string. Ordinarily, that is handled in a different fashion, but this equipment is able to accommodate a range of pipe sizes. Clamping is still achieved for the many pipe sizes.

While the foregoing is directed to the preferred embodiment, the scope is determined by the claims which follow.

I claim:

1. A drill pipe spinner comprising:

(a) an overhead hanger;

(b) a top mounting plate supported by said hanger;

(c) a bottom mounting plate spaced from said top mounting plate;

(d) two spaced drive rollers supported by said top and bottom mounting plates, and each having an axis of rotation enabling the outer portion of said rollers to contact a pipe positioned against said rollers and thereby impart rotation to said pipe;

(e) a controllable motor having a rotatable output member engaging and rotating said drive rollers;

(f) left and right pressure rollers;

(g) left and right moveable mounting arms connected to support said pressure rollers in spaced relationship to said drive rollers and pivotally supported by said top and bottom mounting plates;

(h) operator controlled pressure roller retractors connected by means of an adjustable connection to said mounting arms and thereby moving said pressure rollers between a retracted position and a pipe engaging position by rotating said left and right mounting arms about an arm pivot point for each of said arms;

(i) wherein said adjustable connection allows alteration or movement of said arms with respect to said pressure roller retractors to engage pipe of varying diameter;

(j) an operator control for starting said motor;

(k) a throat formed in said top and bottom mounting plates to enable the pipe of a selected size to be positioned therein so that said drive rollers and pressure rollers clamp said pipe in the pipe engaging position;

(l) wherein:

(1) said top mounting plate is spaced from said bottom mounted plate by a frame member therebetween;

(2) said top and bottom mounting plates support parallel spaced shafts upon which said two spaced drive rollers are supported; and (3) said motor rotatable output member transfers rotation from said motor to said drive rollers through shaft supported sprockets for each of said drive rollers; and (m) wherein said mounting arms position said pressure rollers in said throat so that said rollers clamp said pipe in said throat for rotation and said pipe moves away from said throat when said pressure rollers are in a retracted position.

2. The apparatus of claim 1 wherein said left and right movable mounting arms:

(a) move in pivotal rotation about left and right support shafts;

(b) said left and right support shafts have axes of rotation so that said arms move toward or away from said pipe;

(c) said shafts are between said top and bottom mounting plates;

(d) said arms connect with said pressure roller retractors at at a selected adjustable connection; and (e) said adjustable connection selection defines movement of said arms for a given pressure roller retractor operation.

3. The apparatus of claim 2 wherein said operator controlled pressure roller retractors comprise a piston in a cylinder moving a piston rod wherein said piston rod is powered to extend or retract so that piston rod extension and retraction operates said retractors to move said pressure rollers supported on said left and right movable mounting arms, and wherein said adjustable connection comprises:

(a) a plurality of clevis pivot openings in each said mounting arm;

(b) a clevis attached to said piston rod at the end opposite said cylinder; and (c) a clevis pin.

4. The apparatus of claim 3 wherein said pressure rollers are formed of a sacrificial plastic sleeve.

5. The apparatus of claim 4 wherein said plastic sleeve is placed on a supportive metal sleeve.

6. The apparatus of claim 3 further wherein said operator controlled motor switch is a valve for controlling fluid flow from said valve to said motor and wherein said motor is a fluid responsive motor, and further including a gear box connected between said motor and a rotatable output member.

7. The apparatus of claim 6 wherein said throat is directed radially inwardly from the outer peripheral edge of said top and bottom mounting plates and said pressure rollers are fixedly located within said throat to expose at least a portion of said pressure rollers for contact and engagement with said pipe, and further wherein said pressure rollers move into and out of said throat.

8. The apparatus of claim 7 wherein said pressure rollers are formed of a sacrificial hard plastic material a supportive sleeve.

9. The apparatus of claim 1 wherein said left and right movable mounting arms comprise a bell crank having:

(a) an arm pivot opening within said bell crank;

(b) at least two clevis pivot openings within said bell crank; and (c) at least one affixed member supporting said pressure rollers.

10. The apparatus of claim 9 wherein said operator controlled pressure roller retractors comprise a piston in a cylinder moving a piston rod wherein said piston rod is powered to extend or retract so thatpiston rod extension and retraction operates said retractors to move said pressure rollers supported on said left and right movable mounting arms.

11. The apparatus of claim 10 further wherein said operator controlled motor switch is a valve for controlling fluid flow from said valve to said motor and wherein said motor is a fluid responsive motor, and further including a gear box connected between said motor and said rotatable output member.

12. The apparatus of claim 11 wherein said throat is directed radially inwardly from the outer peripheral edge of said top and bottom mounting plates and said pressure rollers are fixedly located within said throat to expose at least a portion of said pressure rollers for contact and engagement with said pipe, and further wherein said pressure rollers move into and out of said throat.

13. The apparatus of claim 12 wherein said pressure rollers are formed of a sacrificial hard plastic material surrounding a supportive sleeve.

* * * * *